US005497644A

United States Patent [19]

Poloni et al.

[11] Patent Number: 5,497,644

[45] Date of Patent: Mar. 12, 1996

[54] DEVICE TO REPLACE ROLLS ON DUAL-PURPOSE UNIVERSAL ROLLING STANDS

[75] Inventors: Alfredo Poloni, Fogliano di Redipuglia; Fausto Drigani, Zugliano, both of Italy

[73] Assignee: Danieli & C. Officine Meccaniche SpA, Buttrio, Italy

[21] Appl. No.: 319,063

[22] Filed: Mar. 6, 1989

[30] Foreign Application Priority Data

Mar. 11, 1988 [IT] Italy ..... 83341/88

[51] Int. Cl.[6] ..... B21B 31/08

[52] U.S. Cl. ..... 72/239

[58] Field of Search ..... 72/225, 237, 238, 72/239

[56] References Cited

U.S. PATENT DOCUMENTS

| | | | |
|---|---|---|---|
| 3,180,125 | 4/1965 | O'Brien | 72/239 |
| 3,289,282 | 12/1966 | Shaffer . | |
| 3,396,566 | 8/1968 | Alsop et al. | 72/239 |
| 3,782,161 | 1/1974 | McGeeney et al. | 72/239 |
| 3,938,362 | 2/1976 | Falk et al. | 72/225 |
| 4,552,007 | 11/1985 | Mantovan | 72/239 |
| 4,557,130 | 12/1985 | Bond | 72/225 |
| 4,653,304 | 3/1987 | Feldmann et al. | 72/239 |
| 4,715,206 | 12/1987 | Forni | 72/237 |
| 4,905,493 | 3/1990 | Benedetti | 72/239 |

FOREIGN PATENT DOCUMENTS

| | | | |
|---|---|---|---|
| 0040584 | 11/1981 | European Pat. Off. . | |
| 2181954 | 12/1973 | France . | |
| 1245298 | 7/1967 | Germany . | |
| 2362486 | 6/1975 | Germany | 72/225 |
| 54-139866 | 10/1979 | Japan . | |
| 1201431 | 8/1970 | United Kingdom | 72/250 |
| 2137911 | 10/1984 | United Kingdom | 72/225 |
| 8808930 | 9/1988 | WIPO . | |

OTHER PUBLICATIONS

Danieli, *Cartridge Stands*, Mar. (1986).

865 Iron and Steel Engineer, vol. 59(1982) Nov., No. 11, Pittsburgh, PA, L. Forni, "Roll Stands In Modern Bar and Rod Mills."

*Primary Examiner*—Lowell A. Larson
*Assistant Examiner*—Thomas C. Schoeffler
*Attorney, Agent, or Firm*—Evenson, McKeown, Edwards & Lenahan

[57] ABSTRACT

Dual-purpose universal rolling stand, which is suitable to be equipped as a two-high rolling stand (113) and a universal rolling stand (213) and which cooperates with a standardized base plate (29) and comprises four housings (28) with outer support projections (41) and inner arms (47) including lateral position surfaces (48) and specific means to anchor main screwing-down screws (34) and also comprises standardized one-type bearing blocks (36) for the two purposes of the stand, the bearing blocks (36) cooperating with the housings (28) and the main screws (34) to form respectively two first housings/bearing blocks assemblies (30) and two second assemblies (24) of housings/bearing blocks/vertical rolling rings in which the third vertical rolling ring assemblies (25) are included, the first assemblies (30) or the second assemblies (24) being installed facing each other and reciprocally positioned by equipment holder bars (33) and (133) repectively. Device to replace rolls of dual-purpose universal rolling stands (13) whether they be two-high rolling stands (113) or universal rolling stands (213) wherein the stands (13) include first and second assemblies (24–30) which together perform the functions of a movable support, the two-high rolling stands (113) being capable of being converted into universal rolling stands (213) and viceversa, the device comprising a stationary framework (11) having at its center a movable platform (12) with at least two stations (15–16), two movable supports (17) being located axially to the rolls (14–114) as positioned in the first station (15) and being opposed to each other, each movable support (17) cooperating with an at least momentarily stationary standard (18).

9 Claims, 7 Drawing Sheets

DEVICE TO REPLACE ROLLS ON DUAL-PURPOSE UNIVERSAL ROLLING STANDS

This invention concerns a dual-purpose universal rolling stand and also a device to replace pre-equipped assemblies comprising the rolls of standardized universal rolling stands, whether such stands are two-high rolling stands or universal rolling stands. To be more exact, the invention concerns a universal rolling stand of a dual-purpose standardized type and also a device suitable for the speedy replacement of the assembly of rolls and equipment on standardized rolling stands by reducing manual operations and the times for an converting such stand as compared to traditional methods.

This invention is applied in particular to standardized rolling stands cooperating with a standardized base plate.

These pre-equipped stands include common parts for use in their two forms and also have standardized overall bulks.

The stands to which the invention can be applied comprise simplified, standardized housings, which serve to position and support the various equipment of the stands according to the various forms of the stands.

The outer uprights or housings are held together by connection bridges which support and position also the equipment holder bars.

When a standardized universal rolling stand according to the invention is converted into a two-high rolling stand, steps are taken to replace the rolls, remove the vertical bearing blocks and replace the connection bridges.

The reverse takes place when a standardized two-high rolling stand has to be converted into a universal rolling stand.

The known stands entail a plurality of drawbacks. A first drawback is the great variety of parts of which they consist.

Another drawback is the fact that the systems for reciprocal fixture of the known stands are complex and of various types.

A further drawback of the known stands is the complexity of their components and therefore their high costs.

Yet another drawback is the lack of versatility in the adaptation of the main components to the various equipment required.

It is also a drawback that the known stands have not been designed purposely to Facilitate the changing of the rolls and equipment.

The present methods of changing the rolls by using chains or a crane to support the rolls are known.

The normal rolls/bearing block assemblies of the state of the art are opened to replace the rolls and the rolls are changed by conventional handling methods while the bearing blocks are suitably supported.

Methods employing appropriate supports for the rolls while the bearing blocks are handled conventionally are also known.

A proposal of the present applicant is also known whereby a device is used to replace the rolls of rolling stands. This proposal comprises means to support the rolls with cradles to hold the rolls and means to support the bearing blocks, these latter means being able to move at least axially to the rolls. In this proposal the means to hold the rolls and the means to support the bearing blocks are able to move in relation to each other so as to replace the old set of rolls with a new set.

However, these known systems entail a plurality of drawbacks, which consist, on the one hand, of the inability to cooperate both with universal rolling stands and with two-high rolling stands and, on the other hand, of the inability to cooperate with universal rolling stands suitable to work both as universal rolling stands and as two-high rolling stands.

To obviate the cited drawbacks and facilitate the operations of equipping, dismantling, converting, parking and maintaining universal rolling stands and two-high rolling stands, the present applicant has designed, tested and embodied this invention.

According to the invention a dual-purpose standardized stand is provided which is easy to assemble and convert.

According to the invention four housings are provided and comprise projections and also arms to anchor the main screws that regulate the rolling pass.

The outwardly extending projections cooperate by means of slots and hydraulic rings with stanchions located on an enclosure.

The housings include suitable lodgement holes in which are positioned the rods of the equipment holder bars, which are secured therein by fork-shaped clips.

The arms to anchor the main screws comprise seatings for pivots of vertical rolling rings, the seatings serving for the positioning and fixture of the vertical rolling ring assemblies.

The main screws, which can be actuated by upper and lower adjustment assemblies, serve to position the bearing blocks of the horizontal rolls reciprocally.

According to the invention a device is included for speedy replacement of the rolls and other components comprising means to support and position the rolls or means to support and position the housings and bearing blocks or means to position rolling ring assemblies having vertical axes.

As we said earlier, the housings secure and position the means which are anchored in them and which are able to perform the adjustment of the distance between centers of the rolls when the rolls/housings assembly is supported on the device.

This enables all the equipment for the rolls on the relative housings and all the equipment needed for that specific rolling step to be fitted on the stand while still in the workshop. A computer stand is thus achieved with the rolls already positioned and the distance between centers already set.

Moreover, the assemblies for the rolling rings with a vertical axis as employed in standardized stands equipped as universal rolling stands are also pre-positioned and adjusted for the housings holding rolls with a horizontal axis and are fitted on the bearing blocks in their right position, so that when the stand is finally fitted on the standardized base, it is equipped and preset to the required values for its function as a universal rolling stand.

This device, which is to be installed in the workshop serving the rolling mill, enables not only the winches, supports, work benches and adjustment,/equipment to be eliminated but also makes possible the performance of all the operations in shorter times, in smaller spaces, more accurately and with the assurance that all the components of a completed assembly are all already prepared and arranged with a reciprocal adjustment and pre-positioning.

According to the invention a platform or turntable having two stations or positions is included.

Of these two stations or positions, one serves to load and unload the complete stand and also to load a new set of rolls, whereas the other serves for the equipping and dismantling work when the stands are converted.

Supports for the rolls and supports for the equipment holder bars are provided in the station where equipping and dismantling take place or conversion of the stand.

The housings and bearing blocks are able to move axially to the rolls for removal of the housing/bearing block assembly from the rolls.

The support for the rolls is born on a turntable, which by a rotation of 180°, for instance, serves to replace a set of old rolls with a set of new rolls and takes the new set to the position previously occupied by the set of old rolls.

The housing/bearing block assembly with the distance between centers already preset is then brought up to the new rolls thus positioned and is fitted to them together with the equipment holder bars.

The equipment holder bars may hold equipment which has already been pre-positioned or equipment which has only been pre-installed for positioning later.

The equipment may also be installed and positioned on these bars after the stand has been re-assembled.

The stationary supports cooperate substantially with the lateral end of travel of movable supports of the stand and serve to secure, pre-position and support the housing for the vertical rolling rings provided in the universal rolling stands.

The platforms cited here, namely that for the stand itself and any possible platform for the stationary supports, may be of a turntable type or of a type able to move lengthwise and in either case will serve the purposes of the invention equally well.

Where the platforms can move lengthwise, the working position will always be the central one, whereas the loading and unloading positions will be one or the other of the lateral positions respectively.

We shall describe hereinafter an embodiment with a turntable platform since that embodiment comprises also an arrangement capable of lengthwise movement too.

By means of the invention it is possible to equip and/or dismantle and/or convert a standardized two-high rolling stand and a standardized universal rolling stand. It is also possible to pre-arrange and convert a standardized two-high rolling stand into a universal rolling stand and viceversa.

This invention is therefore embodied with a dual-purpose universal rolling stand as disclosed and characterized in the relative main claim, while the relative dependent claims disclose variants of the idea of the solution.

The invention is also embodied with a device to replace the rolls on dual-purpose rolling stands, whether equipped as two-high or universal rolling stands, the device being as disclosed and characterized in the relative main claim, while the relative dependent claims disclose variants of the invention We shall describe hereinafter a preferred embodiment of the invention as a non-restrictive example with the help of the attached figures, in which:

FIG. 1 gives a plan view of a possible embodiment of the invention;

In the description the addition of numbers 1, 2, 3, etc. before the basic number (e.g. basic number 33=equipment holder bar For a two-high rolling stand) indicates an analogous aspect entailing a different dimension or usage (number 133=equipment holder bar for a universal rolling stand).

Figure 4:
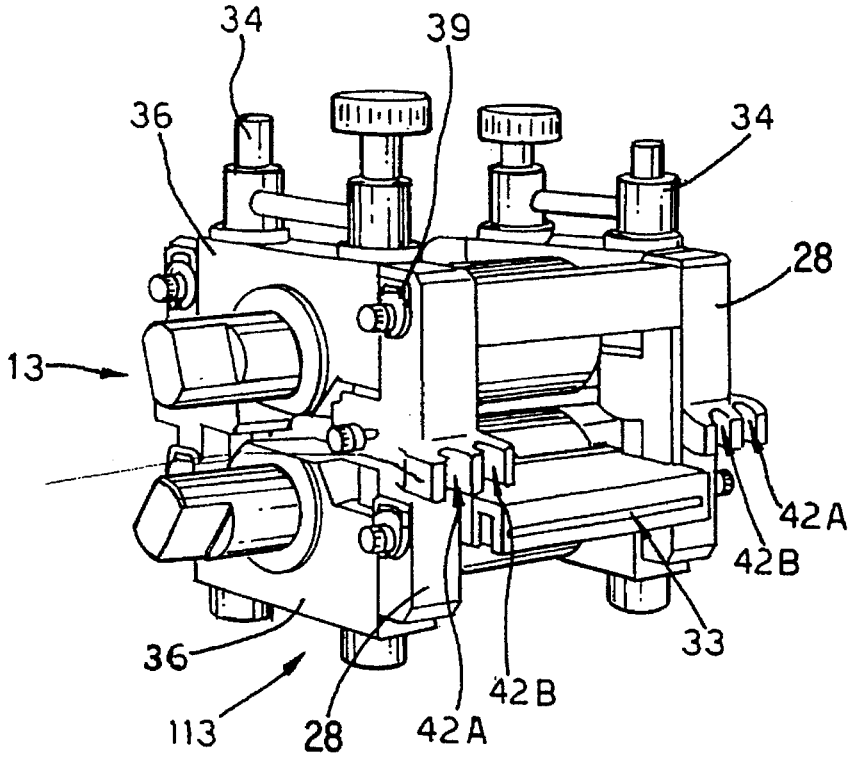
FIGS. 4 and 5 show the stand according to the invention, equipped as a two-high rolling stand and a universal rolling stand respectively.
Figure 5:
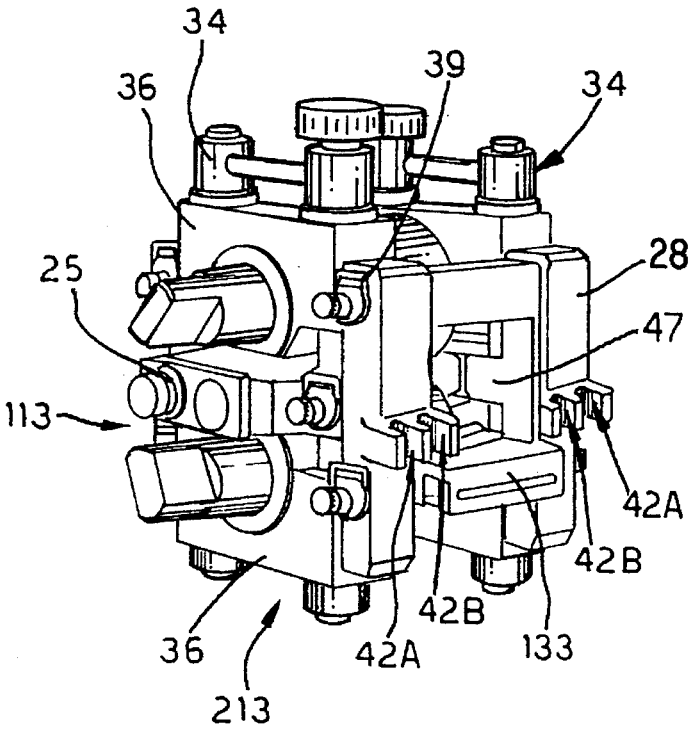
Figure 6:
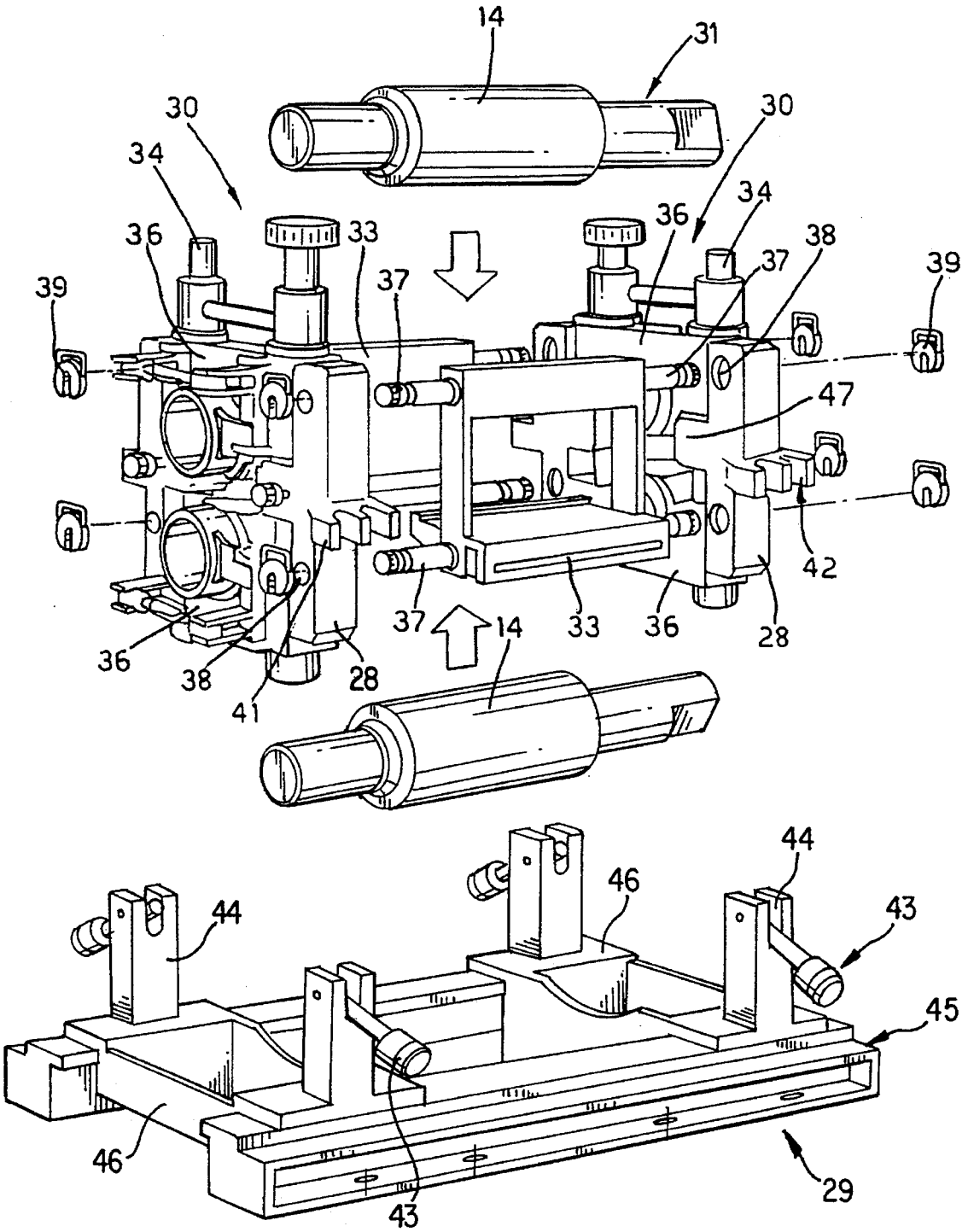
FIG. 6 shows a knock-down view of the two-high rolling stand of FIG. 4.
Figure 7:
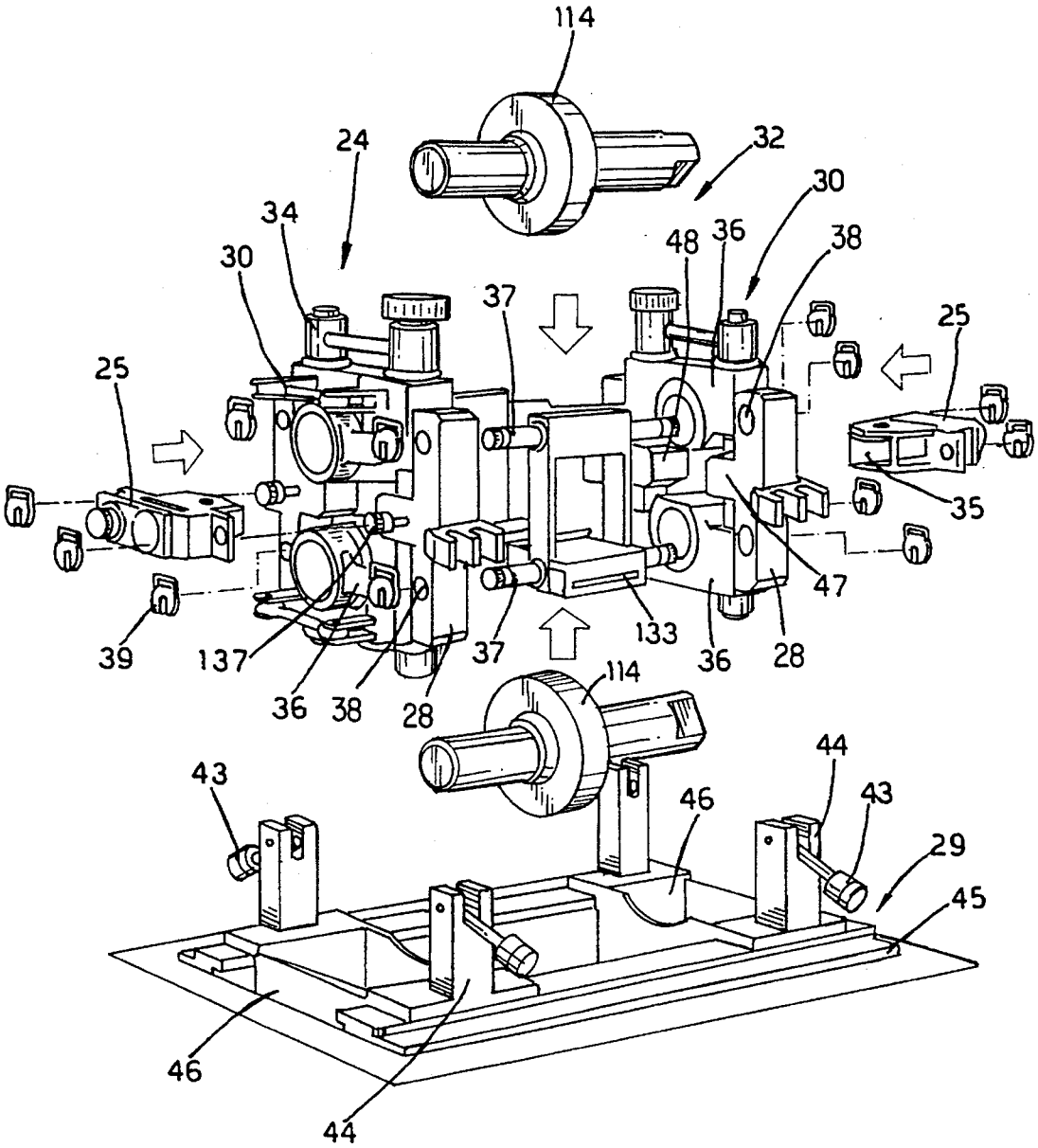
FIG. 7 shows a knock-down view of the universal rolling stand of FIG. 5.
Figure 8:
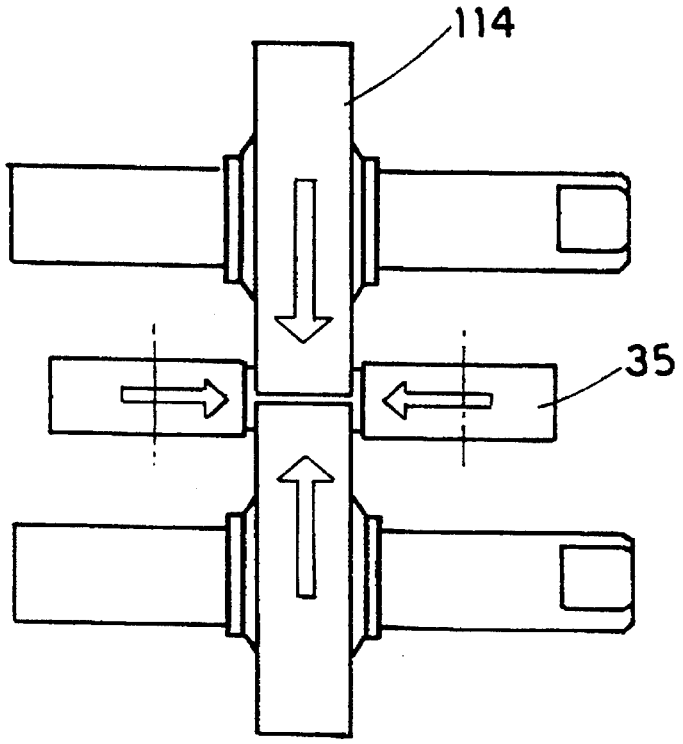
FIG. 8 shows the installation of the pairs of rolls and rolling rings in a universal stand.
Figure 9:
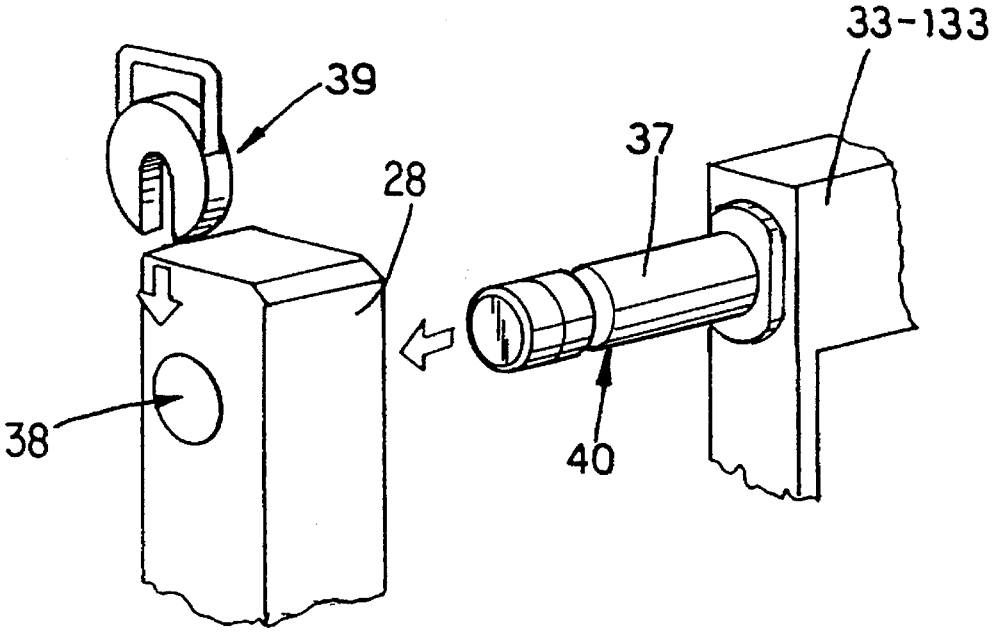
FIG. 9 shows the installation of the equipment holder bars.

FIGS. 4 and 5 show a dual-purpose universal rolling stand according to the invention, equipped in FIG. 4 as a two-high rolling stand 113 and in FIG. 5 as a universal rolling stand 213.

The two stands 113–213 have in common bearing blocks 36, housings 28, main screws 34 for adjusting the rolling pass and, more generally, a first housing/bearing block assembly 30 and each can cooperate with a standardized base plate 29.

In the examples shown the above first assembly 30 together with a third vertical rolling rings assembly 25 is indicated as a second assembly 24; this second assembly 24 remains one single assembled whole when employed to form part of a two-high rolling stand or of a universal rolling stand, wherein it is indicated as assembly 38.

In the stands 113–213 the two-high 113 or universal 213 specialized embodiments are defined by fourth 31 and fifth 32 specialized assemblies respectively.

The fourth specialized assembly 31 comprises rolls 14 and equipment holder bars 33, whereas the fifth specialized assembly 32 includes rolls 114, equipment holder bars 133 and the third assembly 25 of rolling rings 35 having a vertical axis.

The equipment holder bars 33–133 are fitted to the housings 28 by inserting rods 37 of these bars in lodgement holes 38 in the housings and clamping the whole with the fork-shaped clips 39 which fit into peripheral grooves 40 machined on the rods 37.

The housings 28 bear outward projections 41, which in this example include two slots 42A and 423.

One or the other of the slots 42A–42B cooperates with a hydraulic clamping ring 43 in securing the projections 41 to a stanchion 44, thus positioning the pre-installed stand 113–213 according to its function as a two-high or universal rolling stand.

The housings 28 comprise inner arms 47 having surfaces 48 for lateral positioning of the third vertical rolling ring assemblies 25.

The rods 137 are included in cooperation with the inner arms 47 and anchor the vertical rolling rings 35 by means of the fork-shaped clips 39. The inner arms 47 comprise also means to anchor the main screws 34 which cooperate with the respective housings 28. The main screws 34 are connected by an adjustment assembly.

The projections 41 are located advantageously in the neighborhood of a substantially midway point in the vertical extent of the housings 28.

The stanchions 44 are positioned in pairs on frames 46, which in turn are positioned on an enclosure 45. The positioning of the stanchions 44 may be movable or stationary.

The enclosure 45 together with the frames 46 and stanchions 44 constitutes the standardized base plate 29.

The preceding description and the attached drawings show clearly the great advantages provided by simplification and standardization of the parts.

Figure 1:
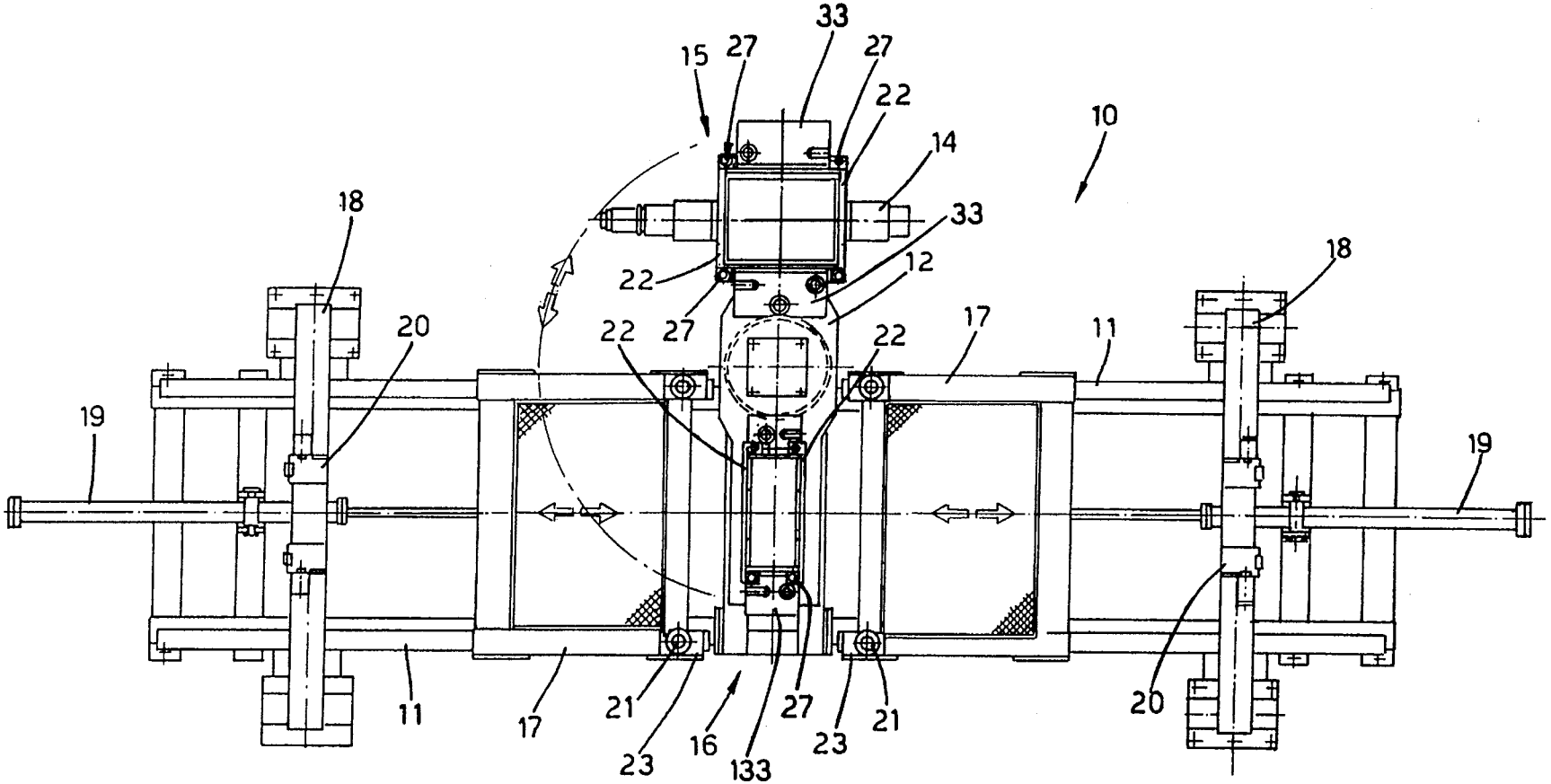

FIG. 1 shows an embodiment in which a device 10 comprises a stationary framework 11 at the center of which is a platform 12, a turntable in this example, with means to support the stand 113 and with containers 22 to hold rolls 14 having a horizontal axis.

The containers 22 hold rolls 14 to accommodate to the geometrical characteristics of either universal or two-high rolling stand and employ a bar 49, able to slide between guide rollers 50, to support the upper roll 14, whereas the lower roll 14 is supported on an appropriate lower surface 51. Lateral surfaces 52 enable the rolls 14–114 to be aligned correctly.

Figure 2:
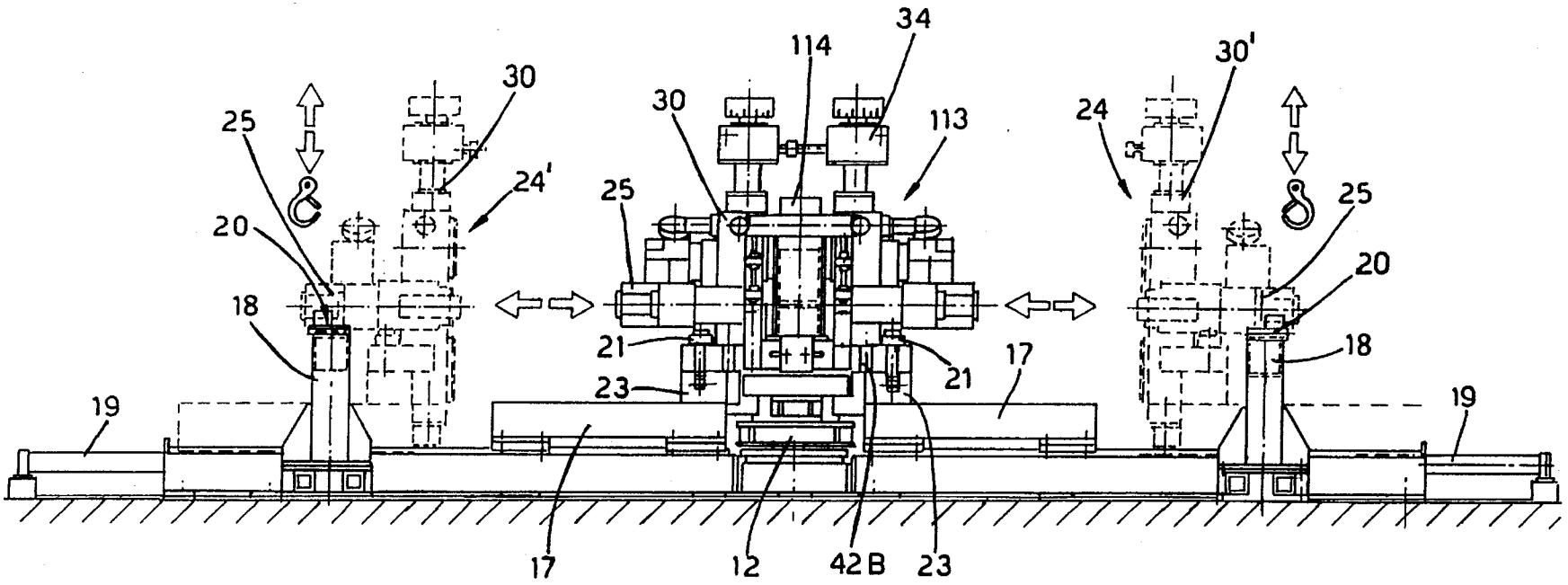
FIG. 2 shows a front view of the embodiment of FIG. 1.
Figure 3:
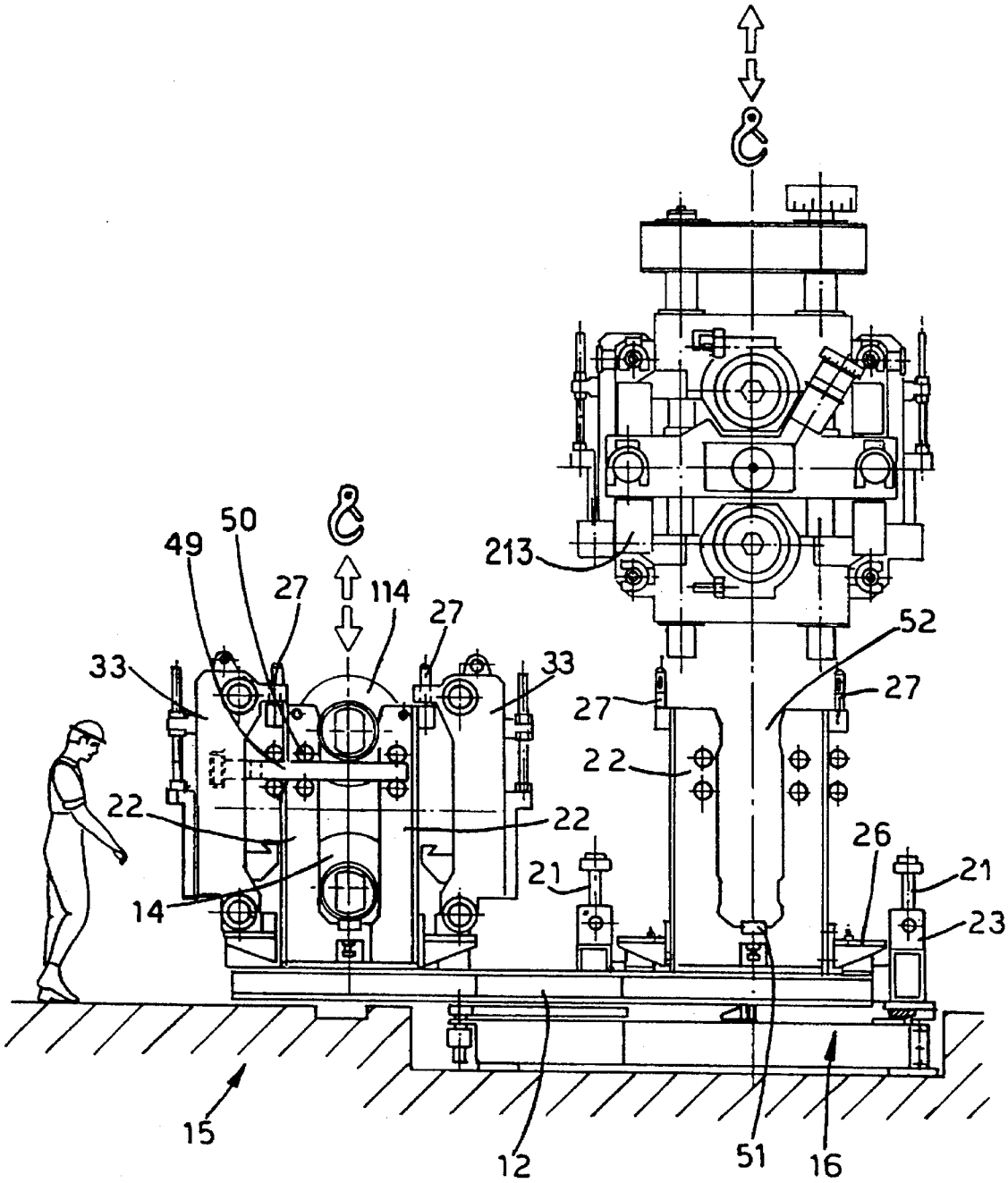
FIG. 3 shows a side view of the embodiment of FIG .1.

The stand shown in FIGS. 2, 3 and 5 is a universal rolling stand 213 or is a two-high rolling stand 113 as shown in FIG. 4.

In this example the turntable 12 is movable between a first station 15 for replacement of rolls 14 and a second station 16 for loading and unloading the stand 213.

Two movable supports 17 are installed together with the second station 16 and on the same axis as the rolls 14–114 included there. These movable supports 17 can move along the axis of the rolls 14–114.

Stationary standards 18 are located in this example substantially in the neighborhood of the end of outward travel of the movable supports 17.

The movable supports 17 are equipped with columns 23 which comprise hydraulic clamping rings 21 that serve to clamp the second assembly 24 and the first assembly 30 in the slots 42A–42B.

The movable supports 17 have a position of maximum reciprocal approach and reproduce the enclosure 45 with the columns 23.

Containers 22 for the rolls are included on the turntable 12 and serve to accommodate and position the rolls 14–114 and to support and position the equipment holder bars 33–133 with pins 27 and support surface 26.

When it is necessary to convert a universal rolling stand 213 into a two-high rolling stand 113, a container 22 for rolls for a universal rolling stand will be located in the second station 16, whereas a container 22 for rolls for a two-high rolling stand will be arranged in the first station 15.

The container 22 for rolls in the first station 15 will be equipped beforehand with the relative equipment holder bars 33, benches for equipment, equipment and rolling rolls 14–114, the whole being pre-positioned already and set to the required values in the first station 15.

When the stand 213 is lowered (FIG. 3) into the second station 16, it cooperates with the specific container 22 For rolls and enables the components of that specific stand to be positioned exactly.

When the stand 213 is placed in the second station 16, it rests on the columns 23 and is clamped by the hydraulic clamping rings 21.

By removing the fork-shaped clips 39 it is possible to displace the movable supports 17, which take with them the second assembly 24. The third assembly 25 consisting of vertical rolling rings 35 is also moved together with the second assembly 24.

This third assembly 25 is taken by the second assembly 24 to the stationary standard 18, where hydraulic clamps 20 anchor the third assembly 25 and enable it to be disengaged from the second assembly 24 by removal of the fork-shaped clips 39, which anchor themselves on the rods 137 fixed to the housings 28.

Work is carried out likewise when it is necessary to convert a two-high rolling stand 113 into a universal rolling stand 213; the third assembly 25 is pre-positioned on the stationary standard 18 and is taken by the movable support 17 which conveys the first assembly 30.

A jack 19 serves to move the movable supports 17.

We claim:

1. A device for replacing rolls of rolling stands and for converting said rolling stands from two-high rolling stands to universal rolling stands and vice versa comprising:

(a) a stationary framework;

(b) a movable platform positioned substantially at the center of said framework, said platform having a first station for replacement of rolls and a second station for loading and unloading of rolling stands, said platform being movable to selectively position said first and second stations;

(c) containers for containing rolls disposed on said platform, said containers being adapted to receive rolls arranged for either universal rolling stands or two high rolling stands; and (d) two movable opposed supports movable towards and away from said movable platform along said framework in cooperation with an at least momentarily stationary standard.

2. A device as claimed in claim 1 wherein said movable supports comprise hydraulic clamps and columns suitable for anchoring and supporting assemblies of dual purpose rolling stands.

3. A device as claimed in claim 1 wherein said stationary standard comprises hydraulic clamps suitable for clamping vertical rolling rings assemblies.

4. A device as claimed in claim 1 wherein said movable platform rotates and said first and second stations are located 180 degrees from each other.

5. A device as claimed in claim 1 wherein said movable platform can move in a straight direction on guides positioned substantially at a right angle to a axis of rolls of rolling stands when said stands are in one of said first and second stations.

6. A device as claimed in claim 1 wherein said containers comprise support surfaces and pins suitable for the support and positioning of equipment holder bars.

7. A device as claimed in claim 1 wherein said containers comprise a bar slidable along guide rollers suitable for positioning and supporting bars for the support of an upper roll of said rolling stands.

8. A device as claimed in claim 1 wherein said movable supports are positioned so as to move substantially along a same axis.

9. A device as claimed in claim 1 wherein said containers comprise lateral surfaces suitable for lateral alignment of rolls of said rolling stands.

* * * * *